US011808070B2

(12) United States Patent
Fornasari

(10) Patent No.: US 11,808,070 B2
(45) Date of Patent: Nov. 7, 2023

(54) RETRACTABLE SLIDING DOOR WITH AUTOMATIC ALIGNMENT TO THE WALL DURING THE CLOSING PHASE

(71) Applicant: TERNO SCORREVOLI S.P.A. UNIPERSONALE, Varedo (IT)

(72) Inventor: Paolo Fornasari, Cordenons (IT)

(73) Assignee: TERNO SCORREVOLI S.P.A. UNIPERSONALE, Varedo (IT)

( * ) Notice: Subject to any disclaimer, the term of this patent is extended or adjusted under 35 U.S.C. 154(b) by 39 days.

(21) Appl. No.: 17/421,682

(22) PCT Filed: Dec. 24, 2019

(86) PCT No.: PCT/EP2019/025483
§ 371 (c)(1),
(2) Date: Jul. 8, 2021

(87) PCT Pub. No.: WO2020/143898
PCT Pub. Date: Jul. 16, 2020

(65) Prior Publication Data

US 2022/0098911 A1 Mar. 31, 2022

(30) Foreign Application Priority Data

Jan. 11, 2019 (IT) ..... 102019000000460

(51) Int. Cl.
*E05D 13/00* (2006.01)
*E05D 15/06* (2006.01)
(Continued)

(52) U.S. Cl.
CPC ..... *E05D 15/0656* (2013.01); *E05D 15/1042* (2013.01); *E06B 3/4645* (2013.01);
(Continued)

(58) Field of Classification Search
CPC ..... E05D 15/0656; E05D 15/1042; E05D 15/0652; E05D 2015/1055; E06B 3/4645;
(Continued)

(56) References Cited

U.S. PATENT DOCUMENTS 929,633 A * 7/1909 Schuyler et al. ..... E04B 1/19 52/654.1
2,732,919 A * 1/1956 Johnson, Jr. ..... E05D 15/0652 16/94 R
(Continued)

FOREIGN PATENT DOCUMENTS

BE 419334 A 1/1973
CH 542982 A 10/1973
(Continued)

OTHER PUBLICATIONS

International Search Report, dated May 2, 2020, for corresponding International Application No. PCT/EP2019/025483.

*Primary Examiner* — Jerry E Redman
(74) *Attorney, Agent, or Firm* — AMSTER ROTHSTEIN & EBENSTEIN LLP

(57) ABSTRACT

A retractable sliding door (10) with automatic alignment to the wall (12) during the closing phase, suitable to alternately open and close a through space (14) made along said wall, comprising a lower guide (18) fixed to the floor and an upper guide (20) forming a support beam. In the upper guide (20) paired prominences (50, 52) and (60) are made constituting the sliding tracks of two or more pairs of wheels (54) and single wheels (58) borne by a shaft (56) and combined with a frame (62) to form a carriage. The lower guide (18) interacts with a roller (24) suitable to fit into a shaped channel with a mixed-line extension (26) made along the lower head of the door (10); the upper guide (20) is provided with a shaped channel (78) having the same and parallel mixed-line configuration as said shaped channel (26). The
(Continued)

upper head of the door (10) being provided with means for its suspension to the frame (62) constituting the carriage.

8 Claims, 12 Drawing Sheets

(51) Int. Cl.
*E05D 15/10* (2006.01)
*E06B 3/46* (2006.01)

(52) U.S. Cl.
CPC ... *E05D 2015/1055* (2013.01); *E05Y 2201/46* (2013.01); *E05Y 2900/132* (2013.01)

(58) Field of Classification Search
CPC ..... E06B 3/4627; E05Y 2201/46; E05Y 2900/132
USPC ..... 49/323
See application file for complete search history.

(56) References Cited

U.S. PATENT DOCUMENTS 3,058,174 A * 10/1962 Sterling ..... E06B 3/4654 49/410
3,400,490 A * 9/1968 Anderson ..... E05D 15/06 49/504
3,493,032 A * 2/1970 Ballard ..... E06B 3/4636 16/87 R
3,494,076 A * 2/1970 Todd ..... E06B 3/4654 49/505
4,325,204 A * 4/1982 Martine ..... E06B 3/4654 49/504
4,561,210 A * 12/1985 Kvas ..... E06B 3/4654 49/504
4,742,645 A * 5/1988 Johnston ..... E06B 3/4654 49/504
6,058,655 A * 5/2000 Gravel ..... B60P 7/14 49/306
6,826,967 B2 12/2004 McDonald
8,079,179 B2 * 12/2011 Lemming ..... E05F 15/638 49/362
8,402,699 B2 * 3/2013 Henriott ..... E06B 3/46 49/411
10,273,743 B2 * 4/2019 Gosling ..... E05F 5/003
10,648,221 B2 * 5/2020 Liu ..... E06B 3/4654
10,689,893 B2 * 6/2020 Selvaag ..... E05D 15/0626
10,808,441 B2 * 10/2020 Fontijn ..... E06B 3/46
10,988,971 B1 * 4/2021 Annazone, Jr. ..... E05D 15/0621
11,519,219 B2 * 12/2022 Everett ..... E06B 3/4654
2004/0003556 A1 * 1/2004 Zerbst ..... E04B 2/7422 52/239
2005/0284027 A1 * 12/2005 Duncan ..... E05B 65/0811 49/372
2006/0230684 A1 * 10/2006 Poole ..... E05D 15/0634 49/409
2009/0272707 A1 * 11/2009 Layton ..... E06B 3/4654 211/153
2010/0236152 A1 * 9/2010 Guzzi-Nicolia .... E05D 15/0652 49/372
2014/0075863 A1 * 3/2014 Laronde ..... E06B 3/4654 52/217
2019/0178022 A1 * 6/2019 Liu ..... E06B 3/4654

FOREIGN PATENT DOCUMENTS

JP 2001303870 A * 10/2001 ..... E06B 3/4654
WO WO-2019227120 A1 * 12/2019

* cited by examiner

Fig.1
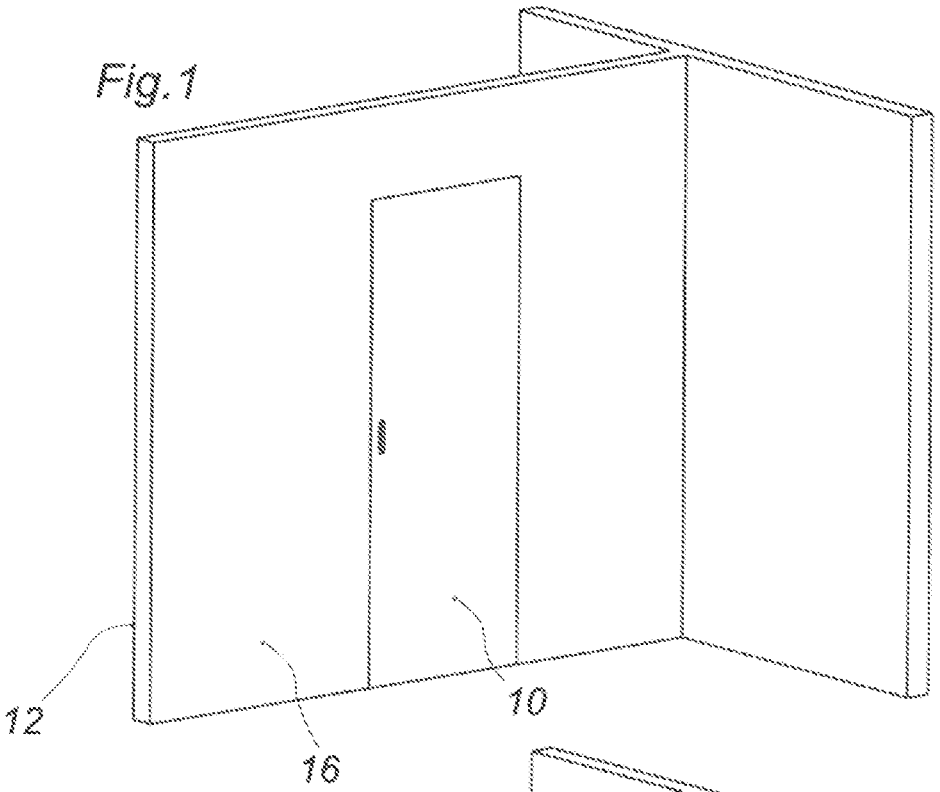
Fig.2
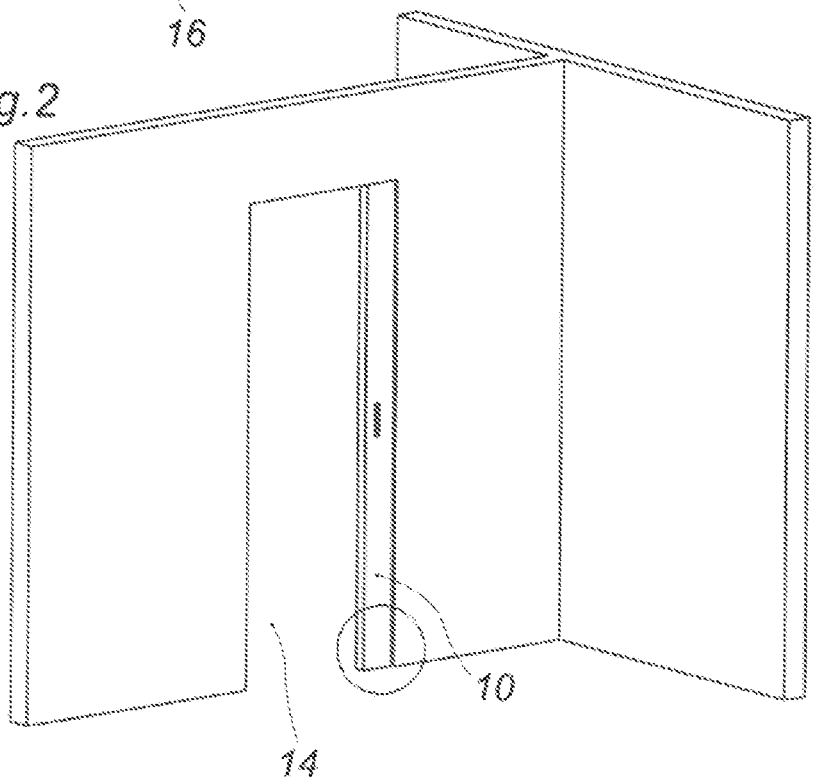
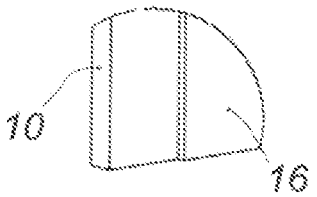
Fig.3

36
36
10
38
42
40
44
34
32
46
34
30
26

Fig.15
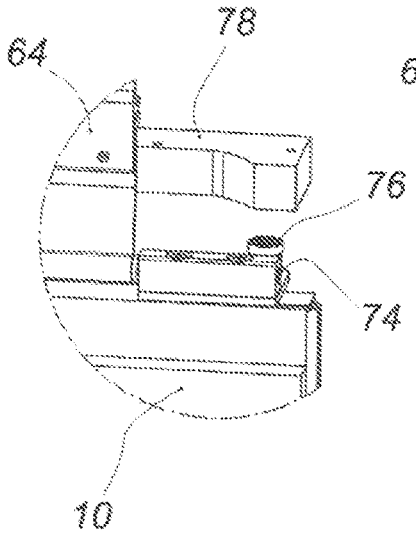
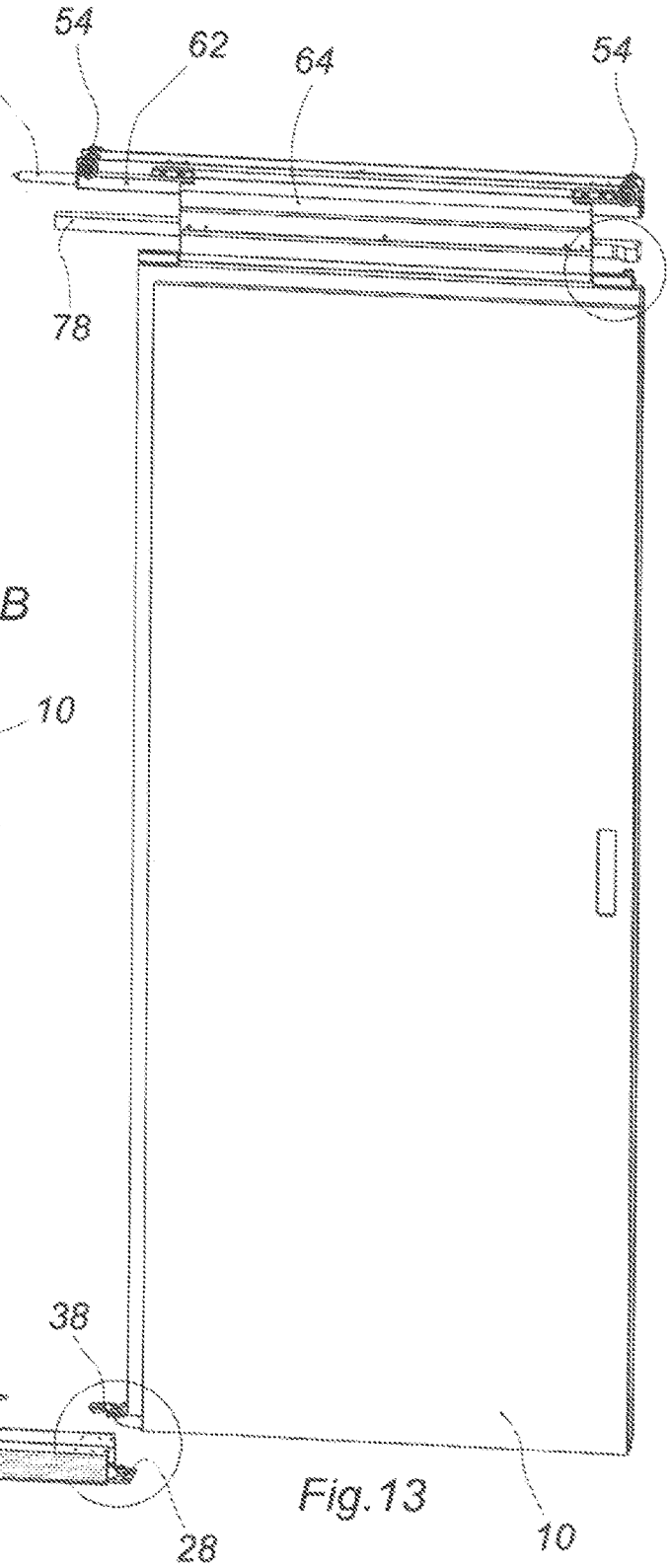
Fig.14B
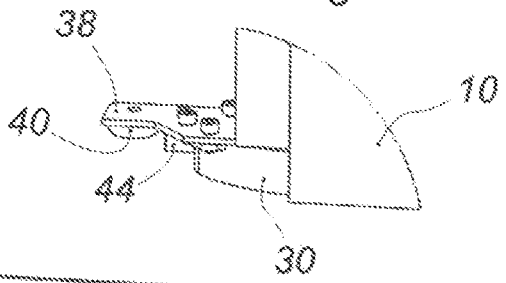
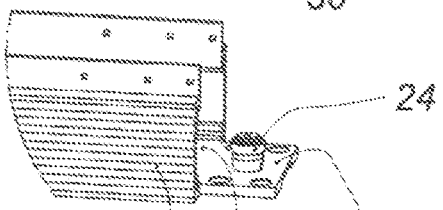
Fig.14A
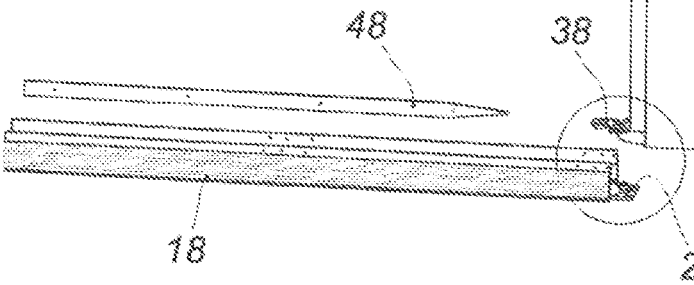
Fig.13

Fig.18
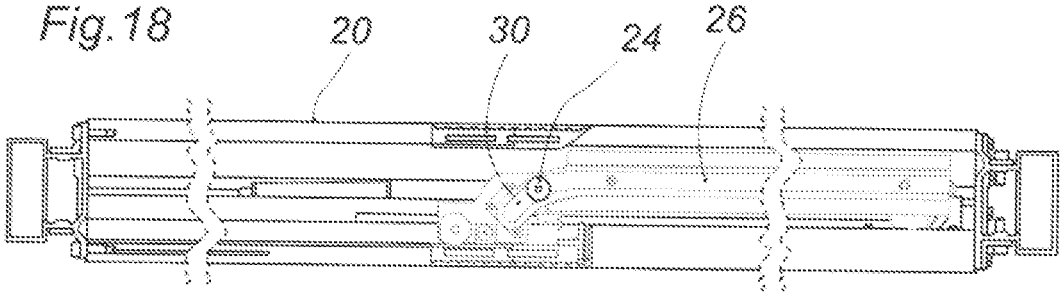
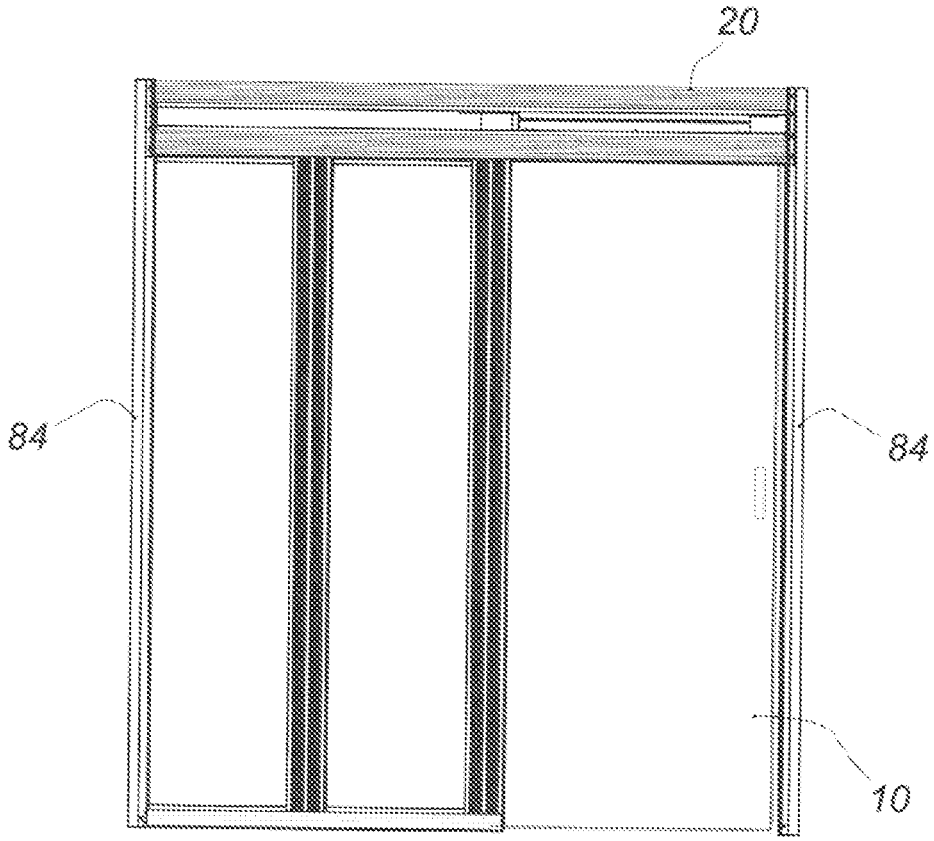
Fig.17

Fig.23
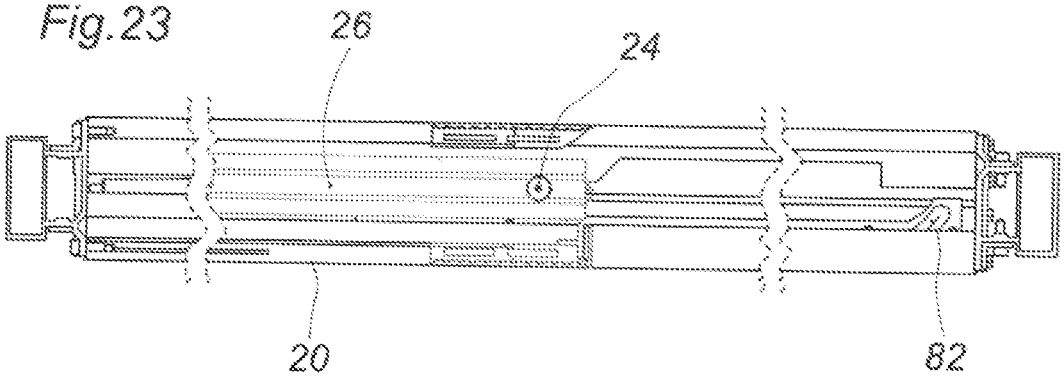
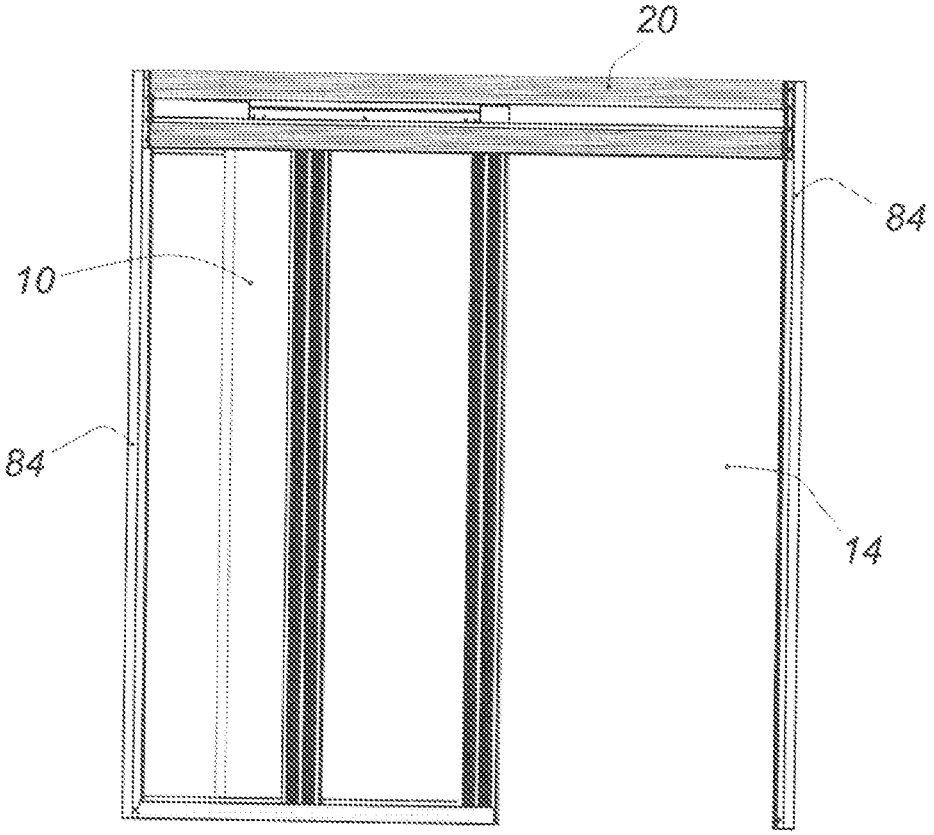
Fig.22

RETRACTABLE SLIDING DOOR WITH AUTOMATIC ALIGNMENT TO THE WALL DURING THE CLOSING PHASE

CROSS REFERENCE TO RELATED APPLICATIONS

This application is a national phase of PCT application No. PCT/EP2019/025483, filed Dec. 24, 2019, which claims priority to IT patent application No. 102019000000460, filed Jan. 11, 2019, all of which are incorporated herein by reference thereto.

FIELD OF INVENTION

The present invention relates to a retractable sliding door with automatic alignment to the wall during the closing phase. More specifically, the present invention relates to a retractable sliding door, as defined above, wherein the door constituting the screening element of the space is configured and moved in such a way as to automatically align, when closed, with the opposite vertical edges of the wall on which the through opening is made.

DESCRIPTION OF RELATED PRIOR ART

As is known, sliding doors are widely used especially for temporarily closing the opening between two adjacent rooms, without occupying space. Such doors, in fact, do not project angularly during opening since they are driven to slide parallel to the wall on which the through opening is made; typically, these sliding doors are retractable, since when open the relative door is housed in a special seat made in the thickness of the wall. Traditionally, the door runs along straight guides and has a significantly reduced thickness to that of the wall that houses it, once driven to close the through space between one room and that adjacent to it, it is placed rearward and misaligned on both sides of the wall, resulting in a noticeable discontinuity in the extension of such wall, given that the door is immediately evident.

U.S. Pat. No. 6,926,867 discloses the solution of making a sliding door with a leaf suspended from an upper arm of a frame provided with a curved channel. When the door is closed, the leaf moves towards the inside of the frame and is pushed against a gasket to provide an airtight seal with said frame. Belgian patent No 419 334 relates to a metal window with a horizontal sliding frame made up of metal profiles connected together. A series of notches along the upper wing of the frame allows instant removal of the frame, which is raised and moved transversely. CH 542 982 discloses a horizontally sliding door designed to form an automatic door for lifts and goods lifts, in which the rollers of each leaf have two convex profile rolling annular surfaces, cooperating with the branches of a support rail with a "V" section.

An evolved and appreciated embodiment of this type of door requires that, once driven into the closed position, it is perfectly aligned with the wall after screening the through passage made on such wall, the only reference detectable on the resulting surface, which is smooth overall, consists of a small recess that allows the user to manually grip and move the sliding door to open or close it. When the door is fully open, it is then invisible, since it is inserted in the aforementioned seat made in the thickness of the wall. This well-known solution, however, has a major drawback, since it involves the preparation and use of a frame that supports a carriage to which two stabilizing bars or arms are hinged at the top to support the leaf, cantilevered. There are similar components also in the lower part of the door, making for a very complex mechanical group, with joints that can generate critical aspects when handling. It is also a mechanism that involves a multiplicity of adjustments and maintenance operations, which often requires laborious intervention to adapt to the masonry and that consequently determine a high cost.

The purpose of the present invention is to overcome the drawbacks complained of above.

SUMMARY

In one aspect, the present invention is to provide a retractable sliding door, with automatic alignment to the wall during the closing phase, wherein the movement mechanism is structurally simple, does not require complex adjustments during assembly or even maintenance or lubrication of the components.

Another aspect of the invention is to provide a retractable sliding door that can be easily adapted to the existing masonry wall structure during installation.

Still another aspect of the invention is to provide a retractable sliding door the movement of which excludes any danger of hitting and damaging the floor of the room in which it is installed.

A further aspect of the invention is to make available to users a retractable sliding door suitable to ensure a high level of resistance and reliability over time, in addition such as to be easily end economically made. These and other aspects are achieved by the retractable sliding door of the present invention according to the claims.

BRIEF DESCRIPTION OF THE DRAWINGS

The construction and functional characteristics of the retractable sliding door of the present invention will be more clearly comprehensible from the detailed description below in which reference is made to the appended drawings which show a preferred and non-limiting embodiment and wherein:

FIG. 1 schematically shows, in an axonometric view, the sliding door of the invention arranged along a wall and in a fully closed condition;

FIG. 2 shows schematically, in an axonometric view, the same sliding door in an almost fully open condition along the wall;

Figure 4:
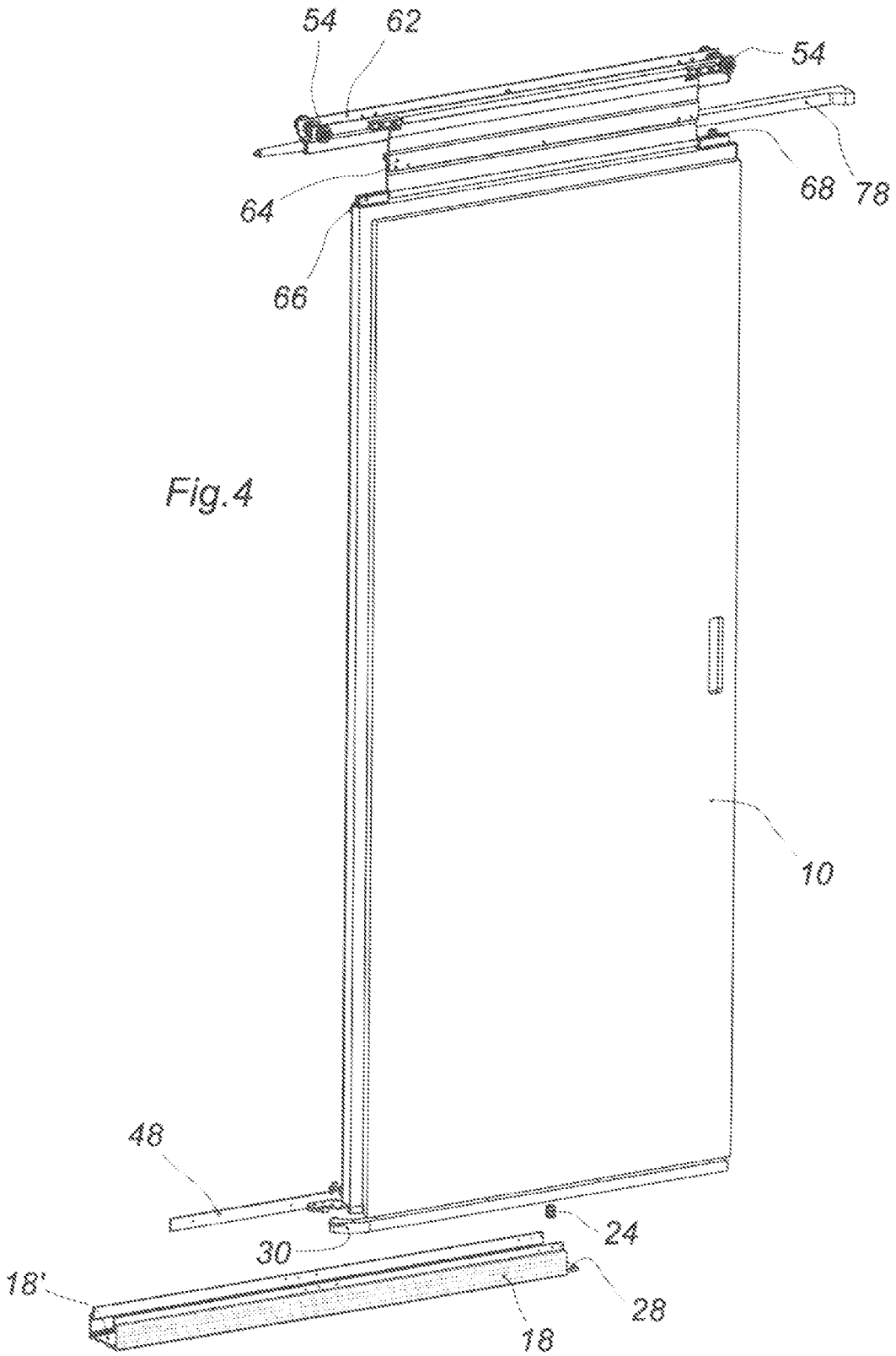
Figure 5:
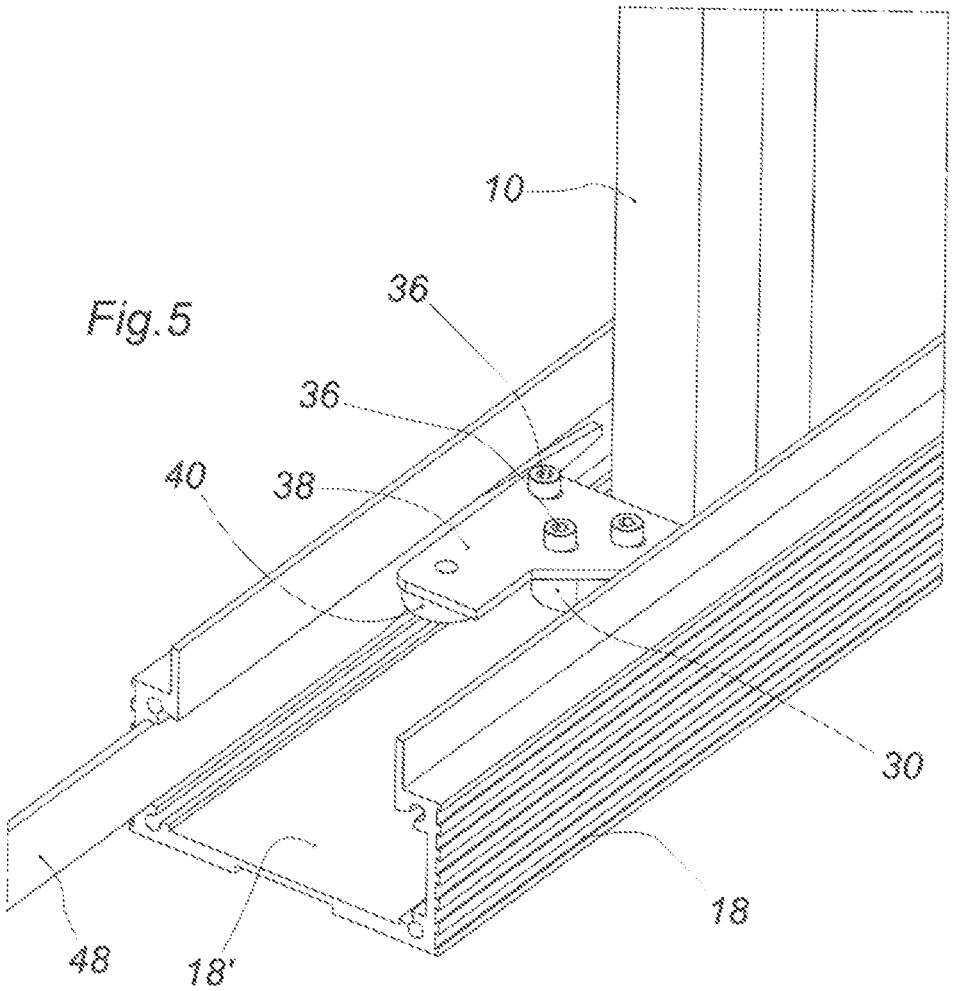
Figure 6:
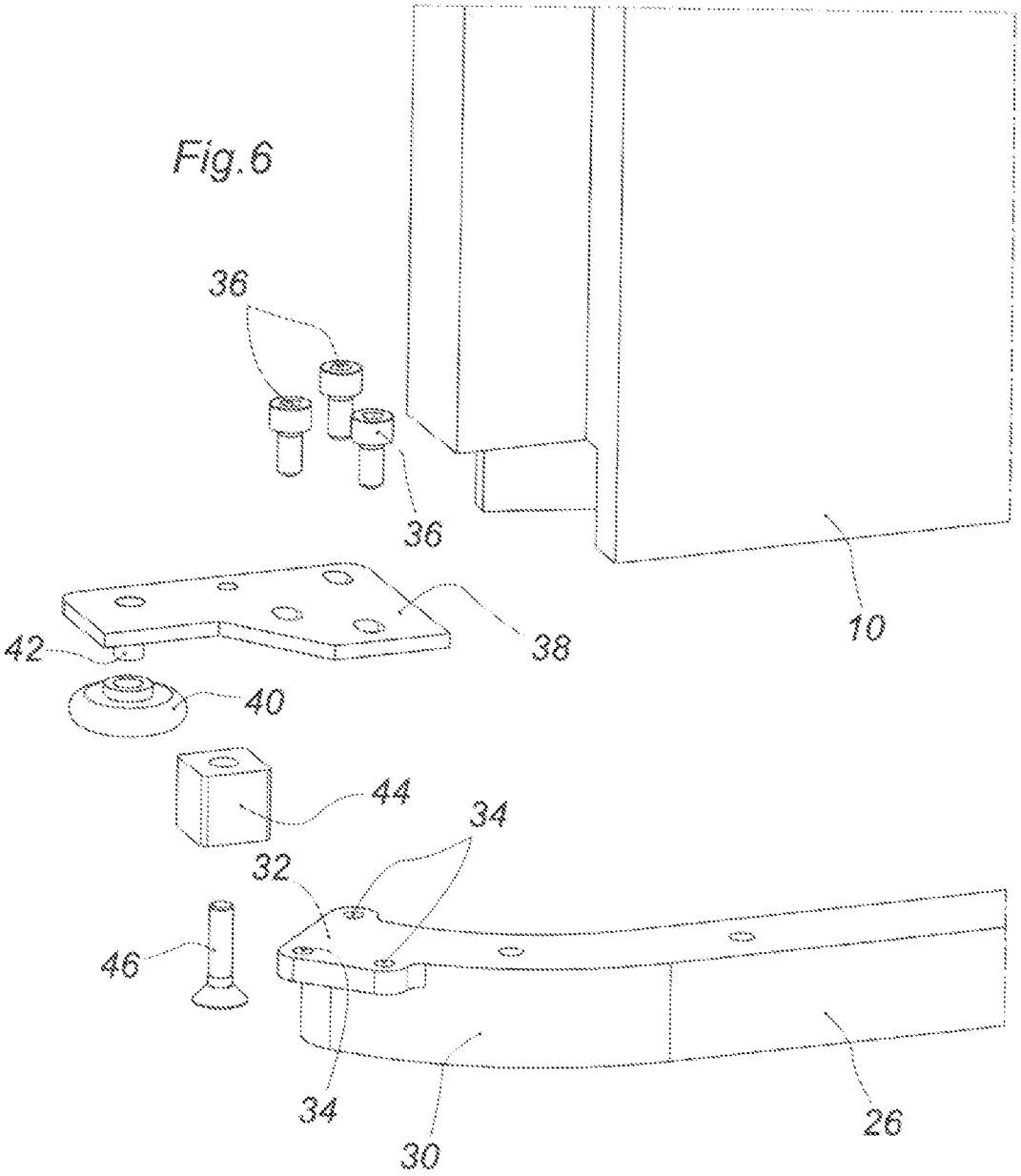
Figure 7:
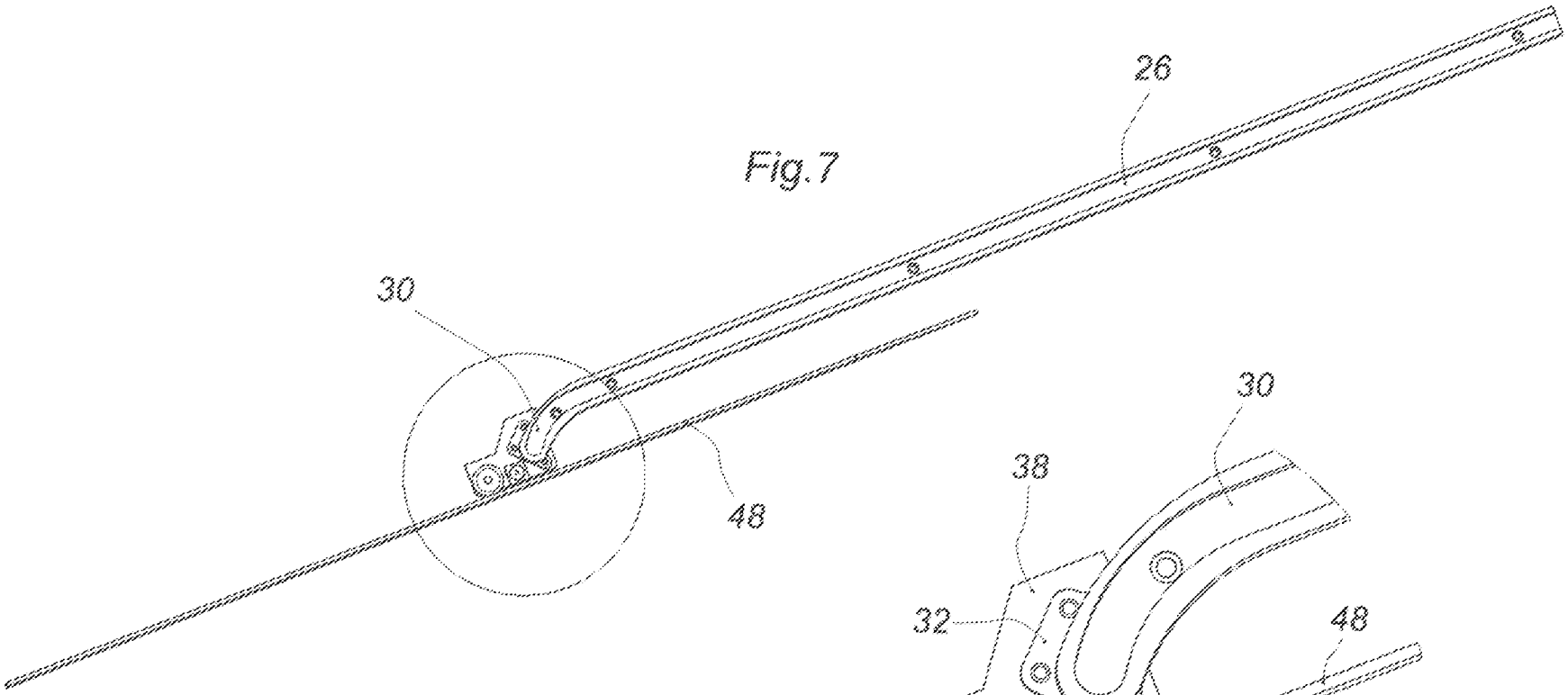
Figure 8:
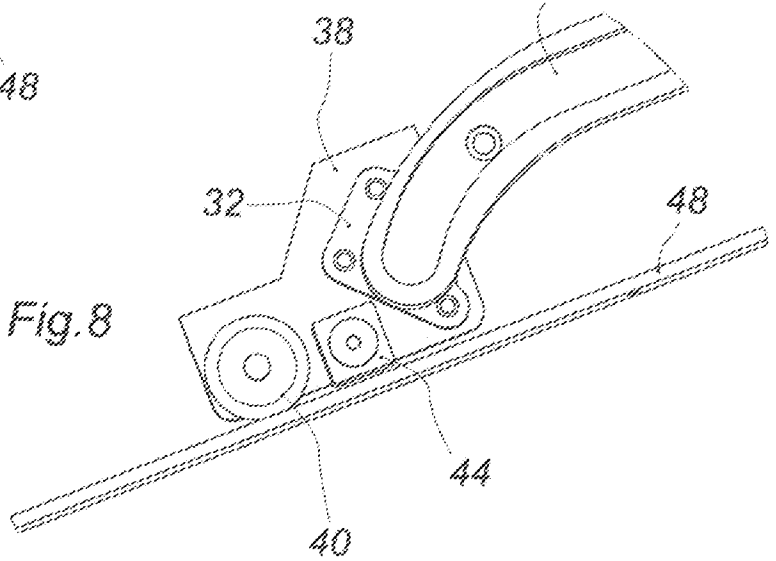
Figure 10:
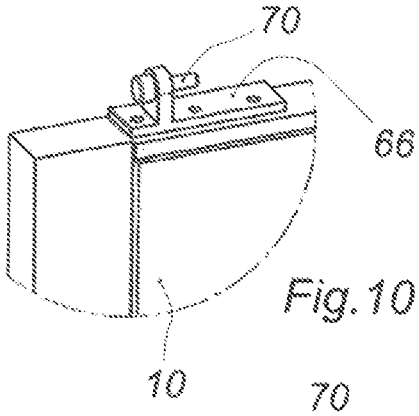
Figure 11:
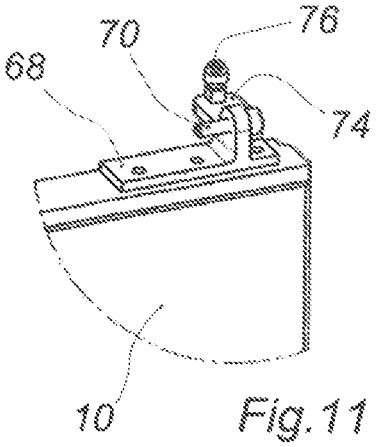
Figure 9:
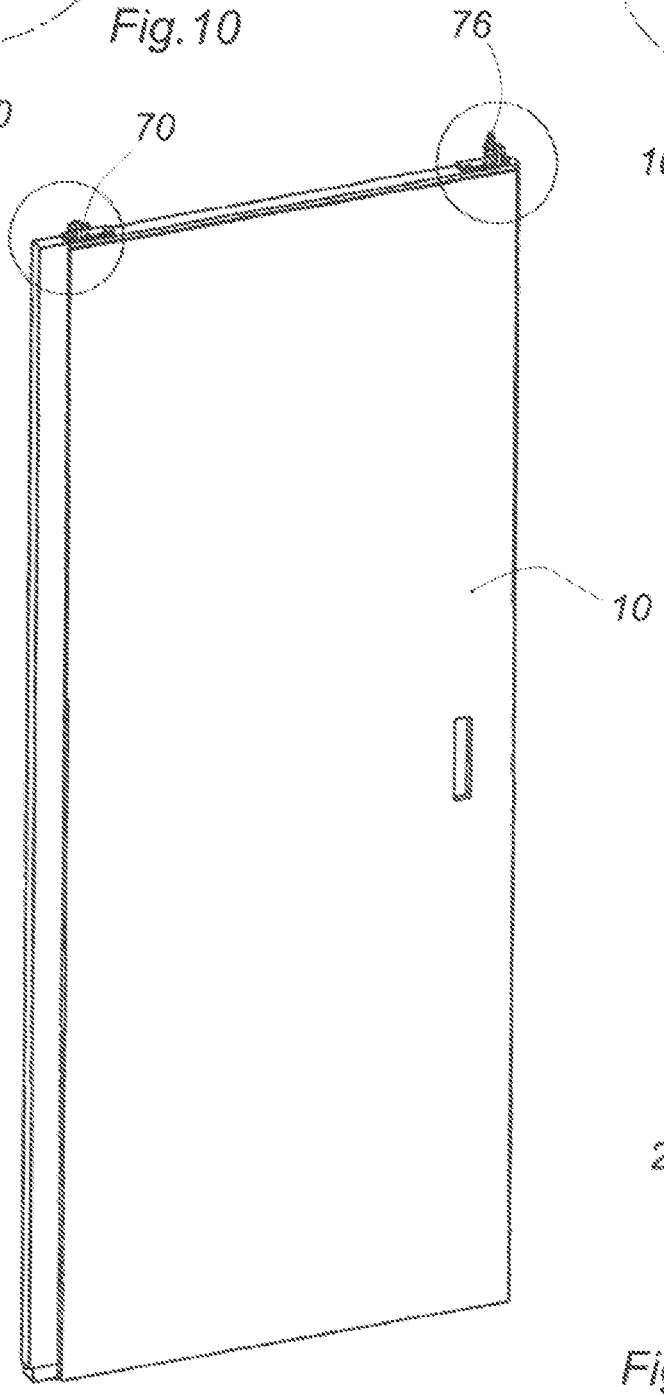
Figure 12:
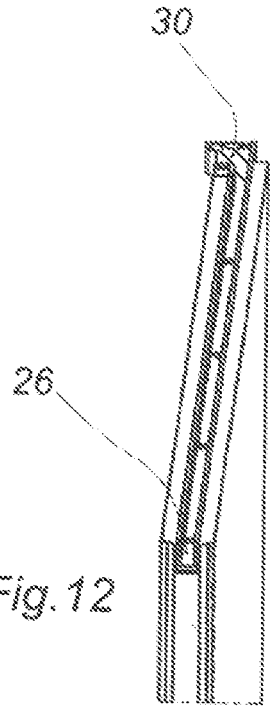
Figure 16:
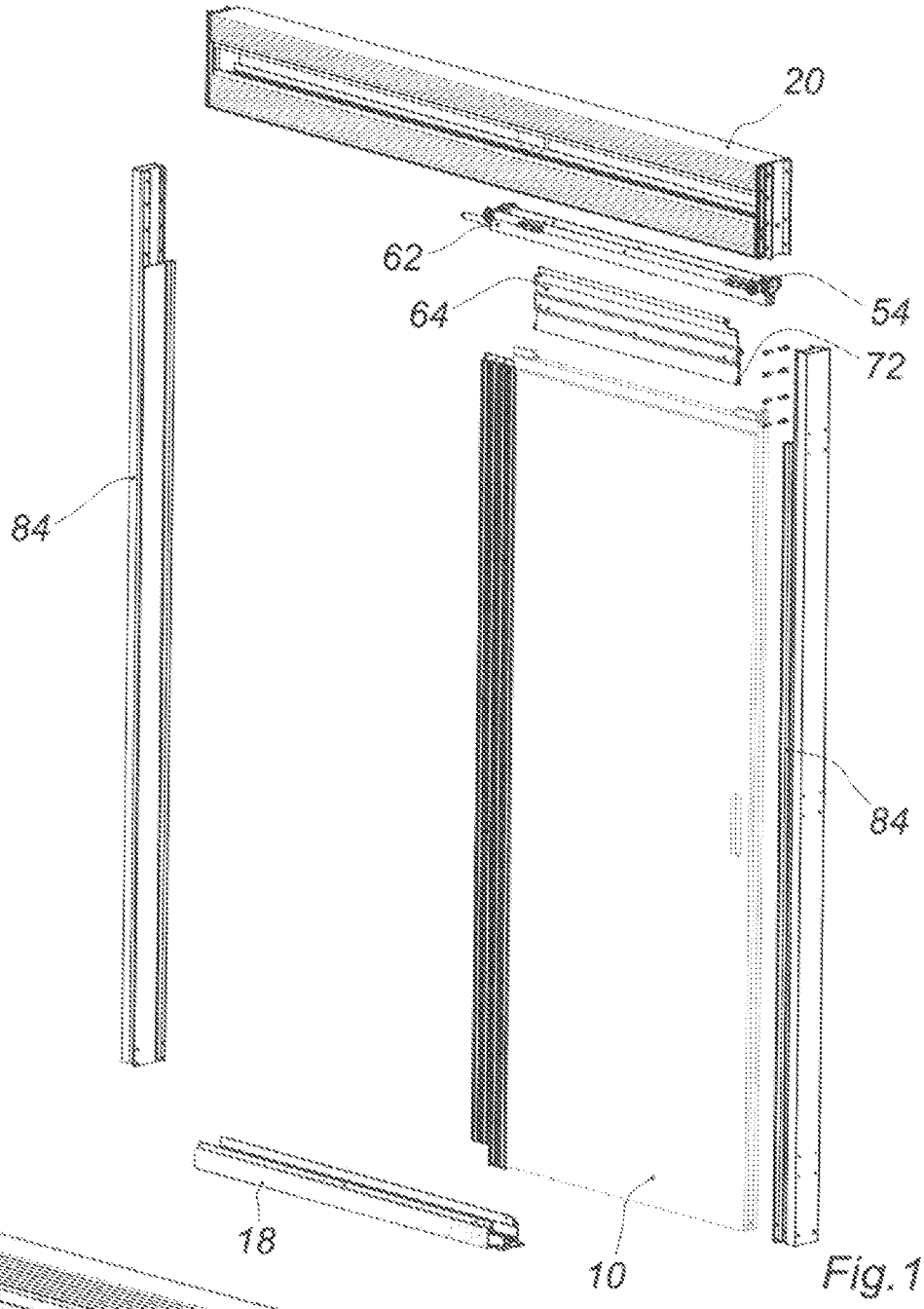
Figure 16A:
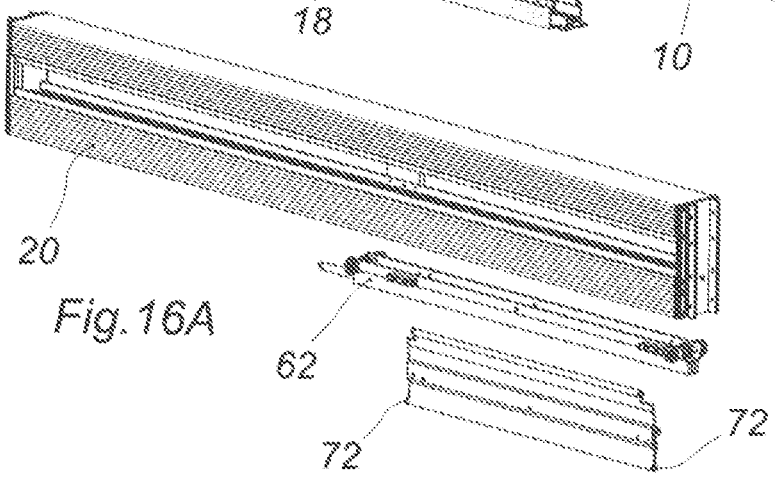
Figure 19:
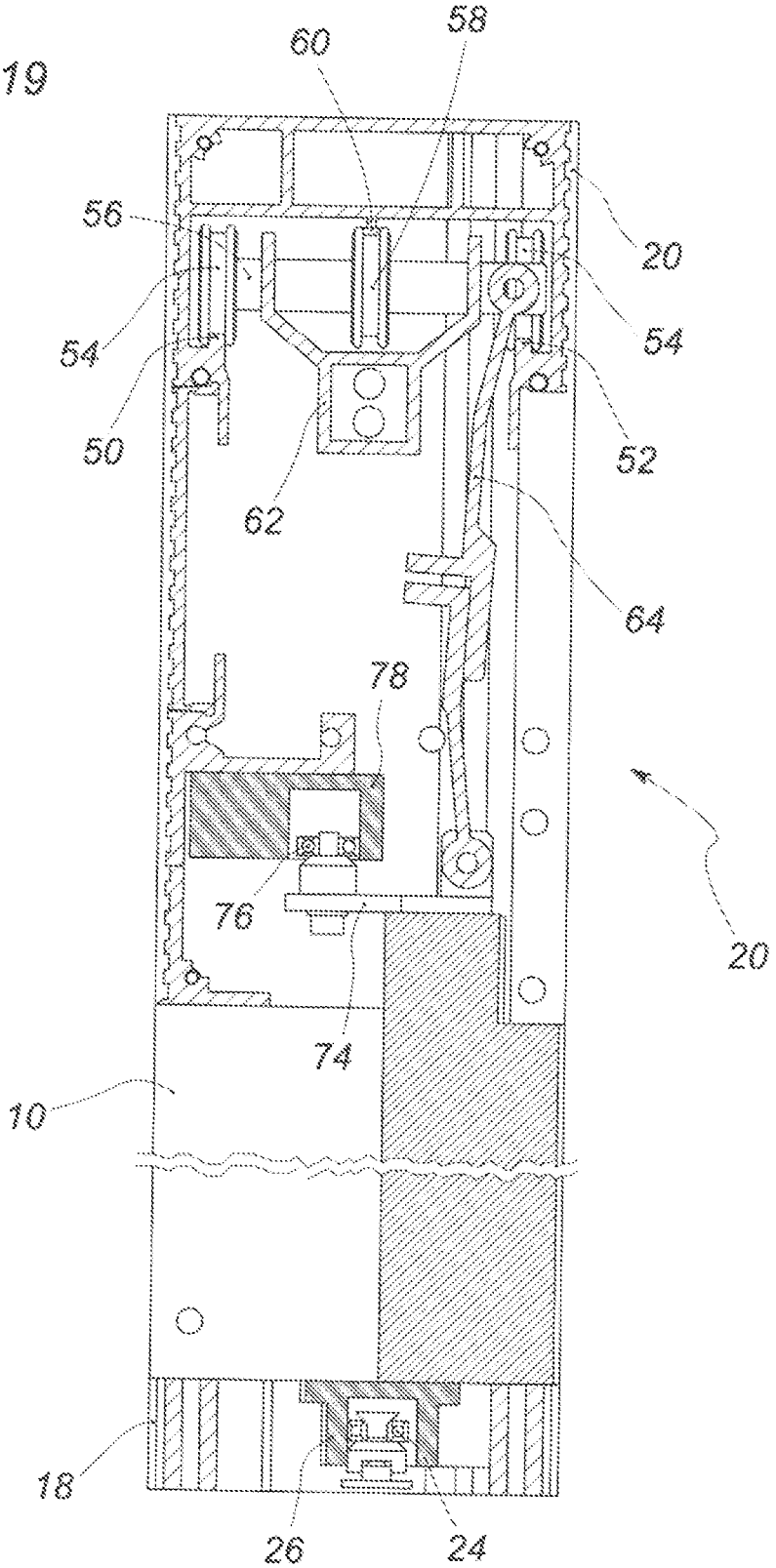
Figure 21:
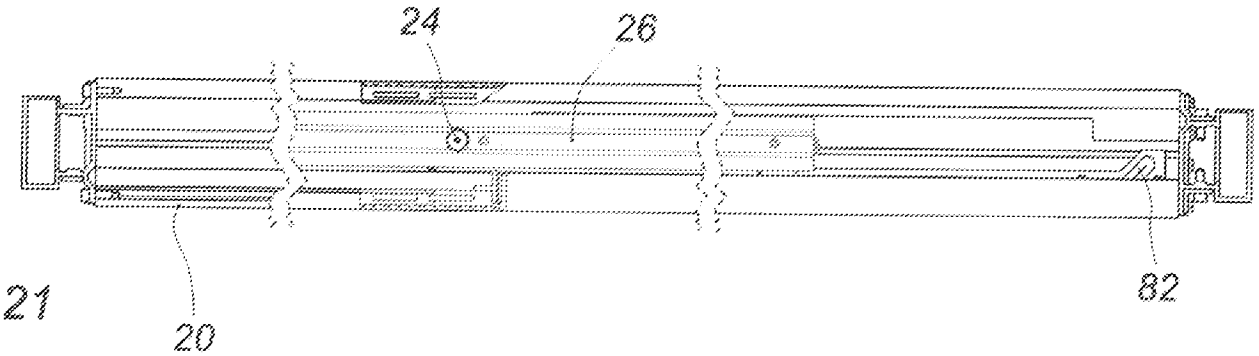
Figure 20:
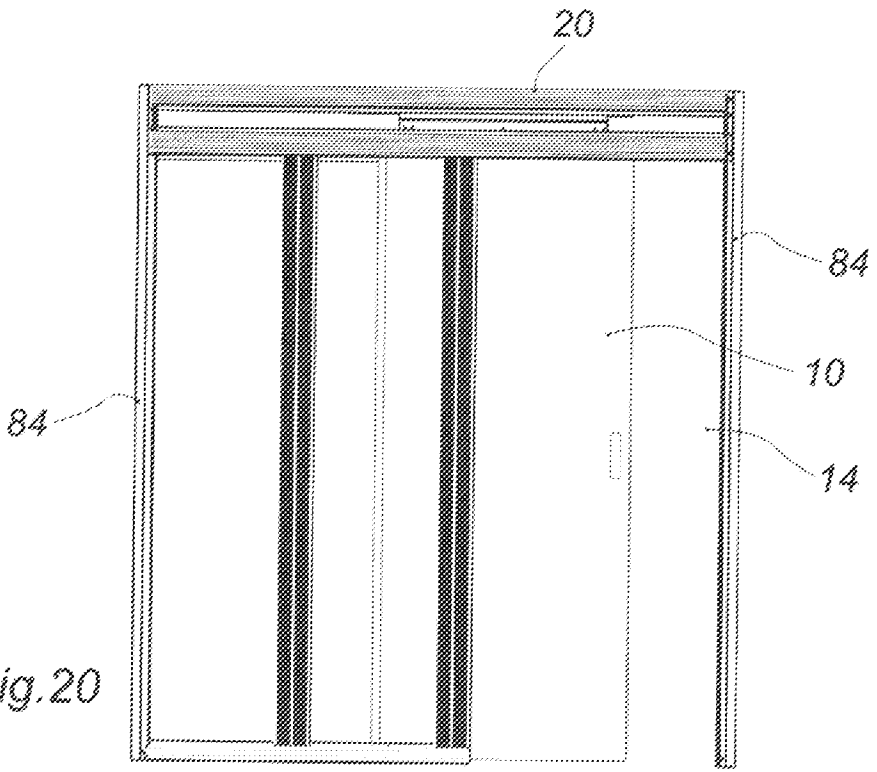

FIG. is an enlarged detail of FIG. 2, showing the door in a rearward position from the wall;

FIG. 4 shows schematically, in an axonometric view, the sliding door of the invention with the relative upper carriage and lower guide;

FIG. 5 schematically represents, in an axonometric view, an enlarged detail of the lower guide of the sliding door;

FIG. 6 schematically represents, in exploded view, part of the components of FIG. 5, together with a portion of the lower guide;

FIG. 7 schematically shows a 90° rotated lateral view of said lower guide;

FIG. 8 is an enlarged detail of FIG. 7;

FIG. 9 schematically represents an axonometric view of the sliding door, with the relative means placed in the upper part for the connection to the support beam;

FIGS. 10 and 11 are enlargements of the means of connection shown in the previous figure;

FIG. 12 shows schematically, in an axonometric view, the lower sliding guide integrated in the base of the same sliding door, seen from below;

FIG. 13 schematically represents a further view of the same sliding door, with its upper carriage and with the lower guide in exploded view;

FIG. 14A schematically shows an enlarged detail of FIG. 13;

FIG. 14B schematically shows a further enlarged detail of FIG. 13;

FIG. 15 schematically represents an enlarged detail of the upper part of the door according to FIG. 13;

FIG. 16 schematically shows an exploded view of the door, its upper and lower guides and the lateral uprights;

FIG. 16A shows a partial enlargement of FIG. 16;

FIG. 17 schematically shows the door assembled and in a fully closed condition;

FIG. 18 shows the sliding door and the upper support beam of said door from below;

FIG. 19 schematically shows a cross-section of said beam, integrating the upper guide of the sliding door;

FIG. 20 schematically shows, in a front view, the sliding door partially open;

FIG. 21 schematically shows the sliding door and the upper beam of the support frame, in a view from below, to highlight the partially open condition of said door;

FIG. 22 schematically shows, in front view, the sliding door in a fully open condition with respect to the support frame;

FIG. 23 schematically shows the sliding door and the upper beam of the support frame in a view from below, to highlight the fully open condition of the door.

DETAILED DESCRIPTION

With initial reference to FIGS. 1 to 3, the retractable sliding door of the present invention, denoted by reference numeral 10, is arranged along a wall 12 and is designed to alternatively open and close a through space 14 made along said wall; in the closed condition, in which said space is completely screened, the sliding door 10 is perfectly aligned with the wall 12, at least on the front or exposed side of said wall, indicated as 16 in FIG. 1. When the door is opened, in order to allow access through the through space 14, this alignment is lost, since said door is made to shift slightly in a transverse direction and then to translate to juxtapose the opposite rear face of wall 12, as shown in FIG. 2 and FIG. 3 in an enlarged detail. Once the door 10 has been opened, it can also be positioned in a special seat made in the wall thickness, according to a known embodiment According to the invention, the retractable sliding door 10, typically consisting of a hollow core leaf or other suitable material, is guided during its movement by means of the respective lower and upper guides, respectively shown as 18 in FIGS. 4, 5 and as 20 in FIGS. 16 and 19.

In detail, the lower guide 18 is formed of a metal profile made, for example, of extruded aluminium, with a substantially "U" shaped section and provided with through holes at the base for its fastening to the floor by means of conventional screws with relative expansion plugs. A roller 24 is fixed to the lower guide 18, visible in FIGS. 4 and 14, which projects upwards from the base 18' and is destined to abut the floor of said guide; said base 18' protrudes on one side from the lower guide 18 with respect to the opposite side walls, as can be seen in particular from FIG. 14A, and forms an extension 28, visible in said figure. From this extension 28 of the base 18', the roller 24 which has the function of guiding the sliding of the door 10 as it is arranged inside a shaped channel 26 which the door is fitted with at the base, protrudes upwards. As can be seen in particular from FIG. 12, which illustrates the door 10 seen from the lower head, the shaped channel 26 is made in the thickness of said door and defines a "U" shape to accommodate the roller 24. The shaped channel 26 extends with a mixed-line, straight line extension substantially for the entire width of the door 10; at one end, the shaped channel 26 forms a circle arc fold 30, oriented in the direction of the rear face of the wall 12, i.e. in the direction of the side opposite that indicated as 16 in FIG. 1.

The end that forms the circle arc fold 30 defines on the upper side a flat and slightly raised surface 32, on which two or more through holes 34 are made for fixing with screws 36 a shaped plate 38 illustrated in detail in FIGS. 5 and 6. The shaped plate 38 forms the support for a wheel 40, arranged horizontally and parallel to said shaped plate 38 on the lower side thereof; the wheel 40, with idle rotation, is fixed with a rivet 42 or the like and its rolling surface is preferably made of anti-friction and sound-absorbing material. As can be seen in particular from FIG. 6, as well as from FIGS. 7 and 8, near the wheel 40, at the same lower side of the shaped plate 38, a magnet 44 is connected with a screw 46, preferably a Neodymium magnet, intended to cooperate with a ferromagnetic tape 48 extending along one of the vertical walls of the lower guide 18 and stabilized therein in a known manner (FIGS. 4, 5 and 13). The magnet 44 guarantees the constant stability of the door 10 as it slides, resulting from the magnetic connection with the tape 48 in the lower guide 18. Preferably, as can be seen from FIGS. 5 and 13, the tape 48 reduces its vertical extension at one end, tapering off and ending with a tendentially pointed part facing the roller 24; this allows the magnetic attraction effect to be modified, which is reduced to make it easier to move the door 10 when opening.

The upper guide 20, which forms a support beam, consists of a box-shaped profile with a substantially rectangular cross-section, oriented in the vertical direction, in the upper part of which paired prominences 50, 52 lengthwise extended are made constituting the sliding tracks of as many pairs of wheels 54 borne by a shaft 56 extending transversely. The carriage is defined by a metal frame 62 that bears two or more pairs of wheels or bearings 54, extending longitudinally in the upper guide 20. FIG. 19, in particular, illustrates in detail the arrangement of the wheels 54, as well as an additional wheel 58 which, according to a preferred embodiment, is positioned between said wheels 54 and is guided along an appendix 60 made in the guide 20 above the prominences 50 and 52. A foil 64 is connected to the metal frame 62, which extends in the direction of the underlying door 10 to which it is hinged, i.e. connected in an articulated manner. The foil 64 is advantageously made of two overlapping elements bolted to each other which can translate in relation to one another so as to be able to initially adjust, during an installation phase, the inclination of the door 10 and make it align correctly with the through space 14 made on the wall 12. Along the lower edge of the foil 64, a puckering is made that forms opposite and complementary puckers or engagement seats indicated as 72 in FIG. 16A, for pins borne by the door 10.

As a function of the aforementioned hinge connection, the upper head of door 10 is provided, at opposite lateral ends, with respective plates 66, 68 (FIGS. 10 and 11), each of which comprises an appendix protruding upwards on which a pin 70 is engaged; the pins 70, oriented in an opposite direction, face each other on the upper head of the door 10 and are the means for realizing the articulated connection between said door and the foil 64. The upper edge of the foil 64 is also provided with a puckering that forms opposite and complementary puckers or engagement seats for pins similar to said pins 70 through which said foil connects to the frame 62.

The plate 68 defines an integral extension 74, oriented in the direction of the rear side of said door, from which a roller 76 similar to the roller 24 of the lower guide 18 projects upwards, as shown in FIG. 11, but in this case movable with the door 10 rather than fixed; the roller 76 has in fact the function of guiding the door 10 in opening and closing, sliding along a shaped channel 78 made in the upper guide 20, as shown schematically in FIG. 19, and fixed therein in a known manner. Said shaped channel is visible in part in FIGS. 21 and 23 where it is indicated as 82 at a curved end thereof which defines the same configuration as the curved end 30 of the shaped channel 26, made along the lower head of the door 10 and shown schematically in FIGS. 7, 8 and 12. The shaped channel 78 extends for the remainder of its extension in a straight pattern substantially for the entire width of the door 10, as does the shaped channel 26 made along the lower head of the door 10 (FIG. 12).

The assembly formed by the door 10, the lower 18 and upper guides 20, the foil 64 and the frame 62 that defines the carriage is assembled in a compact block by means of opposite vertical uprights 84 (FIG. 16) that rest on the ground and that are fixed in a known manner, with brackets or equivalent means, to a wooden or metal frame integrated in the wall structure or plasterboard wall.

Once assembled, the door 10 is hung and hinged to the frame 62 that defines the carriage, consequently to the upper guide 20; in its movement when opening and closing, the door 10 tends to swing as a function of the hinge formed by the foil 64, in the seats 72 of which the pins 70 are inserted. Said door is always perfectly orthogonal to the floor, both along the straight section and the final curved section 30 or 82 of the shaped channels 26 and 78, thanks to the guide rollers 24 and 76. The folds 30 of the shaped channel 26 and 82 of the shaped channel 80 oblige the door 10 to move initially backwards during the opening phase with respect to the exposed side 16 of the wall 12.

FIGS. 18, 21 and 23 show the progressive movement of the roller 24 in the shaped channel 26 of the lower guide 18 and the positions in which said roller is located when the door 10 is closed (FIG. 17), semi-open (FIG. 20) or fully open (FIG. 22). The swinging movement in opening and closing allows the door 10 to rise a few millimetres, so as to avoid contact with the floor during opening and closing and therefore the possible risk of marking and damaging said floor. In particular, the door 10 is raised as a function of its "pendulum" movement; when moved from the lower dead centre, in fact, this movement causes the door to lift, which thus moves away from the floor and avoids rubbing.

The weight of the door, which cantilevers with respect to the hinge point, pushes the door transversely to the direction of sliding when the roller 24 enters the non-straight section 30 of the lower guide 18. The transverse thrust, deriving from the cantilever, also moves the door automatically towards the end stop; it therefore closes automatically as a function of its weight when within a short distance of its closing end stop.

As may be seen from the above, the advantages which the invention achieves are evident.

In the retractable sliding door of the invention, the movement mechanism as a whole is structurally simple, does not require complex adjustments during assembly or subsequent maintenance or lubrication of the components. Said door is also easily adaptable to the existing wall structure during installation and its movement during opening and closing does not involve any danger of hitting and damaging the floor of the room in which it is installed. Additionally, the same door 10 is advantageously able to close itself substantially automatically as a result of its weight, when it is close to the end stop.

Despite the invention having been described above with particular reference to one of its preferred embodiments, made solely by way of a non-limiting example, numerous modifications and variants will appear evident to a person skilled in the art in the light of the above description. The present invention therefore sets out to embrace all the modifications and variants which fall within the sphere and scope of the following claims.

The invention claimed is:

1. A retractable sliding door with automatic alignment to an adjacent wall during a closing phase, the retractable sliding door being arranged to alternatively open and close a through space made along said wall, the retractable sliding door comprising:

a lower guide configured for attachment to a floor and an upper guide forming a support beam in which a pair of projections extend and form opposing sliding tracks which support two or more sets of wheels, each set including a pair of wheels with a single wheel positioned between each pair of wheels, each set of wheels being borne by a common shaft and combined with a frame to form a carriage;

wherein the lower guide interacts with a lower roller arranged to fit into a first shaped channel which is configured as a lower mixed-line extension that is provided along a lower head of the sliding door; the upper guide provided with a second shaped channel arranged with an upper mixed-line extension which is substantially parallel to and has a same arrangement as said first shaped channel;

wherein an upper head of said sliding is suspended from the frame by which the carriage is fixed to opposing ends of said upper head via opposing plates from which respective facing pins protrude in opposite directions, said sliding door being suspended to the frame with interposition of a foil having a lower edge which is provided with opposite and complementary engagement seats which receive said pins of the plates.

2. The retractable sliding door according to claim 1, wherein the lower guide consists of a U-section profile having a base formed between opposing side walls, the base protruding on one side with respect to the opposing side walls and forming an extension from which the lower roller extends upwards, wherein the lower roller is fixed to said extension of the base.

3. The retractable sliding door according to claim 1, wherein at least one of the opposing plates fixed to the upper head of the sliding door defines an integral extension that is oriented in a rearward direction of the sliding door, and from which an upper roller protrudes upwardly and is slidable along the second shaped channel of the upper guide.

4. The retractable sliding door according to claim 1, wherein the first shaped channel that is provided along the lower head of the sliding door and the second shaped channel that is arranged in the upper guide define a rectilinear extension extending substantially an entire width of the sliding door and wherein a first end of the first shaped channel has a first circle arc fold, and wherein a first end of the second shaped channel has a second circle arc fold.

5. The retractable sliding door according to claim 4, wherein the first end forming the first circle arc fold includes a flat and slightly raised surface for interfacing with a shaped plate having a wheel with idle rotation, the wheel being arranged horizontally and parallel to a lower surface of said shaped plate.

6. The retractable sliding door according to claim 5, wherein a magnet is attached to the lower surface of the shaped plate proximate the wheel, the magnet being arranged to cooperate with a ferromagnetic tape extending along a vertical wall of the lower guide.

7. The retractable sliding door according to claim 1, wherein the foil includes two overlapping elements that are bolted to each other, wherein an upper edge of said foil is provided with engagement seats for receiving a second set of corresponding connection pins to the frame.

8. The retractable sliding door according to claim 1, wherein the sliding door, the lower and upper guides, and the frame connected to the foil are assembled in a block with opposing vertical uprights.

* * * * *